US010480317B2

(12) United States Patent
Zhao et al.

(10) Patent No.: US 10,480,317 B2
(45) Date of Patent: Nov. 19, 2019

(54) CLUSTER-TYPE DEEP-SEA SUBMARINE MINING EQUIPMENT BASED ON VORTEX HYDRODYNAMIC CHARACTERISTICS

(71) Applicant: Shanghai Jiao Tong University, Shanghai (CN)

(72) Inventors: Guocheng Zhao, Shanghai (CN); Weijie Zhao, Shanghai (CN); Jianmin Yang, Shanghai (CN); Tao Peng, Shanghai (CN); Longfei Xiao, Shanghai (CN); Xinliang Tian, Shanghai (CN); Haining Lu, Shanghai (CN); Yufeng Kou, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 22 days.

(21) Appl. No.: 16/172,269

(22) Filed: Oct. 26, 2018

(65) Prior Publication Data

US 2019/0063218 A1 Feb. 28, 2019

Related U.S. Application Data

(63) Continuation of application No. PCT/CN2017/079648, filed on Apr. 7, 2017.

(51) Int. Cl.
*E21C 50/00* (2006.01)
*E02F 3/90* (2006.01)
(Continued)

(52) U.S. Cl.
CPC ..... *E21C 50/00* (2013.01); *E02F 3/905* (2013.01); *E02F 3/9262* (2013.01); *E02F 7/005* (2013.01); *E02F 3/8858* (2013.01); *E02F 5/006* (2013.01)

(58) Field of Classification Search
CPC ..... E21C 50/00; E02F 7/00
(Continued)

(56) References Cited

U.S. PATENT DOCUMENTS

2014/0137442 A1* 5/2014 Jones ..... E02F 7/005 37/307

FOREIGN PATENT DOCUMENTS

AU 2009100534 7/2009
CN 1180634 5/1998
(Continued)

OTHER PUBLICATIONS

Korean document KR 2015040003 A , Apr. 2015, 3 pages.*
(Continued)

*Primary Examiner* — Sunil Singh
(74) *Attorney, Agent, or Firm* — Leason Ellis LLP

(57) ABSTRACT

A piece of submarine mining equipment comprises an equipment body, a plurality of adaptive submarine mining collectors and respective mineral delivery pipes. The equipment body and the adaptive submarine mining collectors are connected through the mineral delivery pipes. The lengths, stretching out of the equipment body, of the mineral delivery pipes can be adjusted under control. The adaptive submarine mining collectors are provided with tracked traveling mechanisms and can autonomously travel under control. An underwater detector is used for detecting the submarine topography and mineral distribution in the vicinity of an operation area, and the traveling path of the submarine mining collectors and a mineral storage vehicle is reasonably planned according to detected information. The multiple adaptive submarine mining collectors simultaneously and independently work and are made light and small, thus reducing damage of mining operations to the submarine ecological environment. The equipment body can travel
(Continued)

along flat submarine paths and avoid rough paths. Horizontal vortexes induced by the mining collectors can enhance the mining effect and improve the collecting power under unit power consumption so that fewer water pumps with smaller sizes can be configured, and the mining collectors have a smaller principle dimension, thereby greatly reducing energy consumption and being more environmentally friendly.

14 Claims, 6 Drawing Sheets

(51) Int. Cl.

| | |
|---|---|
| ***E02F 3/92*** | (2006.01) |
| ***E02F 7/00*** | (2006.01) |
| *E02F 3/88* | (2006.01) |
| *E02F 5/00* | (2006.01) |

(58) Field of Classification Search
USPC ..... 299/9; 37/308, 317–320, 342
See application file for complete search history.

(56) References Cited

FOREIGN PATENT DOCUMENTS

| | | |
|---|---|---|
| CN | 102425420 | 4/2012 |
| CN | 104653184 | 5/2015 |
| CN | 105332874 | 2/2016 |
| CN | 105350968 | 2/2016 |
| DE | 19715284 | 10/1998 |
| DE | 19902133 A1 * | 7/2000 |

OTHER PUBLICATIONS

Korean document KR 2015042589 A, Apr. 2015, 3 pages.*
International Search Report dated Jul. 12, 2017 corresponding to International Patent Application No. PCT/CN2017/079648.
Written Opinion dated Jul. 12, 2017 corresponding to International Patent Application No. PCT/CN2017/079648; 7 pages (including English translation of the Written Opinion dated Jan. 2, 2019).

* cited by examiner

CLUSTER-TYPE DEEP-SEA SUBMARINE MINING EQUIPMENT BASED ON VORTEX HYDRODYNAMIC CHARACTERISTICS

BACKGROUND OF THE INVENTION

Technical Field

The invention relates to a piece of submarine mining equipment, in particular to a piece of submarine mining equipment capable of achieving intelligent and collaborative operations.

Description of Related Art

The ocean is the largest potential resource base, which has not yet been sufficiently explored or exploited by humans, on the earth. Besides marine oil and gas and coastal ore sand, there are many other metal mineral resources (such as polymetallic nodules, cobalt-rich crusts and polymetallic sulfides) that of commercial mining value on the seabed. These minerals are rich in nickel, cobalt, copper, manganese, gold, silver, etc., of which the total reserve may be dozens or even thousands times larger than that on land. In 2013, China has successfully explored another cobalt-rich crust district in the Pacific Ocean. There is no doubt that deep-sea mining equipment is indispensible for exploitation of deep-sea mineral resources. Made in China 2025 published on May 19, 2015 has pointed out the direction of "Manufacturing Power" and has listed "Ocean Engineering Equipment and High-tech Ship" as one of the top ten strategic goals to focus on research, development and nationalization of advanced ocean engineering equipment.

Along with the development of the modern communication technology and the popularization of automatic control, intelligent design has received more and more attention. In recent years, intelligent equipment has been widely applied to various fields such as the power field, the machinery field, the chemical field, the pharmaceutical field, the construction field and the logistics field. Under this background, it will be an irresistible tread to develop intelligent ocean engineering equipment, and particularly for deep-sea operations, intelligent and automatic operation equipment can greatly reduce manpower and material investment and effectively improve operation efficiency, thereby being of great significance for reasonable exploitation of marine resources.

Existing submarine mining equipment has the following drawbacks:

The integrated structure of mining collectors and an equipment body presents restrictions of traveling paths (the paths should not be too rough), and consequentially, the mining scope is limited.

In order to ensure the mining efficiency, the traveling speed of the equipment has to be increased, and consequentially, the controllability and reliability of the equipment are affected.

The mining collectors are poor in collection capacity. Chinese Patent Application No. CN105350968A, filed on Feb. 24, 2016, discloses a submarine mining vehicle comprising a suction hood which is provided with a spiral guide plate and water jet nozzles. As can be seen from accompanying drawings, the spiral guide plate is in poor fit with the water jet nozzles, and the spiral guide plate in such form has a limited effect on improving the collection capacity. Besides, poor airtightness of the suction cover may also result in the poor collection capacity.

The mining collectors are likely to collide with minerals or other obstacles when moving along with the equipment body; the mining collectors have to be lifted upwards to avoid the obstacles, which causes a loss of the collecting power; and if the mining collectors fail to avoid the obstacles in time, the mining collectors will be damaged due to collision.

Insufficient detection of the complex underwater terrain or mineral distribution of existing submarine mining equipment in the traveling process severely affects correct guidance and determination of the traveling path as well as the avoidance of high-risk operation areas.

BRIEF SUMMARY OF THE INVENTION

The objective of the invention is to provide a piece of submarine mining equipment, which is provided with mining collectors as well as an equipment body separated from the mining collectors, wherein the mining collectors can move freely to search for an appropriate mining area for exploitation while the equipment body travels at a low speed, so that the mining efficiency is improved, the collection capacity of the mining collectors is improved, and the mining collectors can avoid obstacles.

The technical solution adopted by the invention is as follows:

Cluster-type deep-sea submarine mining equipment based on vortex hydrodynamic characteristics comprises an equipment body, a plurality of adaptive submarine mining collectors 10 and respective mineral delivery pipes. The equipment body and the adaptive submarine mining collectors 10 are connected through the mineral delivery pipes. The lengths, stretching out of the equipment body, of the mineral delivery pipes can be adjusted under control. The adaptive submarine mining collectors 10 are provided with tracked traveling mechanisms and can autonomously travel under control. Compared with the traditional integrated structure, such design effectively improves the movement flexibility; and the altitudes of the mining collectors with respect to the seabed will not change rapidly along with the terrain, and thus, the mining efficiency is stable.

Furthermore, a plurality of small tracks 19 are evenly disposed around each adaptive submarine mining collector 10 to form the corresponding tracked traveling mechanism.

Furthermore, an enclosing cover 18 is disposed around the bottom of each adaptive submarine mining collector 10. The enclosing covers can retreat inwards to rise when about to bump against obstacles and can automatically fall under the effect of gravity after passing over the obstacles, and thus, the bottom sealing effect of the mining collectors is improved.

Furthermore, a plurality of guide plates 23 are disposed around the interior of each adaptive submarine mining collector 10. At least two adjacent guide plates of each adaptive submarine mining collector 10 are provided with a water spray head 22 therebetween. The water spray heads spray clear water to generate vortexes in the adaptive submarine mining collectors 10, so that the collection capacity of the adaptive submarine mining collectors 10 is improved. The enclosing covers 18 are provided with guide grooves 20 used for guiding outside seawater into the adaptive submarine mining collectors 10.

Furthermore, the enclosing covers are each of a multi-section structure with every two adjacent sections partially overlapping with each other, so that the vortex effect is generated when outside seawater enters the adaptive submarine mining collectors 10; and water guide structures formed on the overlapped parts are matched with the guide plates 23 in guiding direction.

Furthermore, the cluster-type deep-sea submarine mining equipment further comprises an underwater detector. The underwater detector is electrically connected with the equipment body in a wired manner, automatically travels in front and above the equipment body and has a visual detection or sonar detection function.

Furthermore, the underwater detector comprises a sonar detector 1, an electronic equipment compartment 2, a plurality of propellers 4, multi-degree-of-freedom connectors 3 corresponding to the propellers 4, a tail wing 5 and an optical cable 6. Traveling and steering of the underwater detector can be adjusted by adjusting the rotating direction of the propellers 4 through the multi-degree-of-freedom connectors. The optical cable 6 is connected with the equipment body.

Furthermore, the equipment body is provided with a mineral storage compartment 7, mineral inlets 8, shock absorbers 11, a plurality of tracked traveling devices, a mineral outlet 13, an external mineral delivery pipe 14 and an underwater detector berth 16. The maximum traveling speed of the tracked traveling devices is 1 m/s, and the maximum traveling speed of the tracked traveling mechanisms is 3 m/s.

Furthermore, each adaptive submarine mining collector 10 is provided with a saucer-shaped cover 17, an enclosing cover 18, small tracks 19, guide grooves 20 and a water pump 21.

Furthermore, the mineral storage compartment 7 is used for storing raw mineral materials from the adaptive submarine mining collectors 10, and a crushing device is disposed in the mineral storage compartment 7 and can crush large mineral particles into fine particles capable of being hydraulically delivered. When the quantity of raw mineral materials stored in the mineral storage compartment 7 reaches a certain degree, the raw mineral materials can be delivered into a submarine buffer compartment by a large pulp pump. Furthermore, mechanical devices used for adjusting the lengths of flat mineral delivery pipes 9 are disposed in the mineral inlets 8 so that the flat mineral delivery pipes 9 can freely stretch and retreat and can be prevented from intertwining with one another.

Furthermore, the mineral storage compartment 7 is provided with a pressure reducing valve 15. When the pressure in the mineral storage compartment is excessively high, seawater in the mineral storage compartment 7 can be discharged through the pressure reducing valve 15 to reduce the pressure in the mineral storage compartment 7.

Furthermore, each adaptive submarine mining collector 10 is provided with a cover body including a saucer-shaped cover 17 and an enclosing cover 18.

Furthermore, each enclosing cover 18 has a plurality of layers of folds, thereby being high in retractility and flexibility.

Furthermore, the equipment body is of a python-type all-terrain double-tracked vehicle form and is provided with two tracked vehicles, which are arranged with one in front of the other, are connected in a hinged manner and have the drive capacity. The front tracked vehicle is provided with water pumps and flat mineral delivery pipe adjustment devices, and the rear tracked vehicle is provided with a crushing device, a storage device and a delivery device.

Furthermore, the collection frequency of specific vortexes, generated by the mining collectors 10, to mineral particles is close to inherent vibration frequency of the mineral particles half buried in sea mud, so that the mineral particles in sea mud is excited to resonate so as to be extracted from sea mud more easily.

The invention has the following beneficial effects:

1) The multiple independent adaptive submarine mining collectors are adopted and connected with the equipment body through the flexible mineral delivery pipes, so that the mining scope is widened, and the equipment body can travel along flat submarine paths and avoid rough paths; and compared with the traditional integrated structure, this design effectively improves the movement flexibility, and the altitudes of the mining collectors with respect to the seabed will not rapidly change along with the terrain, so that the mining efficiency is stable.

2) The traveling speed of the equipment body can be greatly decreased, so that the reliability and controllability of the equipment body are improved while the mining efficiency is ensured; and as the traveling speed is low, the pervasion of sea mud can be reduced in the traveling process, which does less harm on the submarine environment.

3) The adaptive submarine mining collectors are provided with the enclosing covers, so that the collecting power is improved; the enclosing covers are each have a plurality of layers of folds and can rise to avoid obstacles after being stressed, thus, having high retractility and flexibility; the enclosing covers can cover the ocean bottom in a mining area, have high submarine topography adaptability and can reduce disturbance on the surrounding submarine environment; the surface of each enclosing cover is provided with a plurality of guide grooves used for inducing a horizontal vortex, so that the mining effect is improved, the collecting power under unit energy consumption is improved, and thus, fewer water pumps with smaller sizes can be configured, and the mining collectors have a smaller principle dimension, thereby greatly reducing energy consumption and being more environmentally friendly.

4) The guide plates are disposed in the guide grooves, and the water spray heads are disposed between the adjacent guide plates, so that the vortex effect is enhanced, and the collection capacity is improved.

5) The enclosing covers can upwards retreat to avoid obstacles, so that the mining collectors are protected against damage while the collecting power is improved.

6) The underwater detector is adopted and floats in front and above the equipment body to detect the submarine topography and mineral distribution in the vicinity of an operation area, and the design of the underwater detector meets the requirement for intelligent deep-sea mining.

7) The underwater detector is provided with the electronic equipment compartment, and electronic equipment used for navigation control, detection, mining, mineral delivery and the like are disposed in the electronic equipment compartment instead of being disposed on a mineral storage vehicle, so that the mineral storage vehicle has a lower weight and can smoothly travel on the seabed, thereby being safe in structure and capable of saving energy.

8) The underwater detector is connected with the mineral storage vehicle through the optical cable which integrates optical fibers and metal wires, so that both the requirement for supplying power to the underwater detector and the requirement for transmitting control signals from the underwater detector to the mineral storage vehicle are met, and thus, the underwater detector and the mineral storage vehicle can work collaboratively.

9) The mineral storage vehicle is provided with the tracked traveling devices which are in surface contact with the seabed; and compared with a point contact way, the tracked traveling devices can better adapt to the soft submarine geological condition, exert a small pressure on the seabed and have greater traction, thereby being capable of travelling continuously and steadily.

10) The multiple adaptive submarine mining collectors work simultaneously and independently and are controlled by a system to each cover a certain working range, so that compared with a single submarine mining collector, the multiple submarine mining collectors work in a wider scope, thus, effectively improving the total quantity of minerals collected in unit time, improving the work efficiency and shortening the task cycle.

11) The flat mineral delivery pipes integrate mineral delivery pipes and optical cables, so that delivery of minerals and power supply and control of the mining collectors are facilitated; and as the degree of freedom of deformation of the flat mineral delivery pipes is limited, the flat mineral delivery pipes can freely stretch and retreat and are prevented from intertwining with one another, and the reliability of the equipment is improved.

12) The mining collectors are provided with the enclosing covers, which having multiple layers of folds and thus has good retractility and flexibility; and the enclosing covers can cover the ocean bottom in a mining area, thereby having high submarine topography adaptability and reducing disturbance on the surrounding submarine environment.

In the figures: 1, sonar detector; 2, electronic equipment compartment; 3, multi-degree-of-freedom connector; 4, propeller; 5, tail wing; 6, optical cable; 7, mineral storage compartment; 8, mineral inlet; 9, flat mineral delivery pipe; 10, adaptive submarine mining collector; 11, shock absorber; 12, tracked traveling device; 13, mineral outlet; 14, external mineral delivery pipe; 15, pressure reducing valve; 16, underwater detector berth; 17, saucer-shaped cover; 18, enclosing cover; 19, small track; 20, guide groove; 21, water pump; 22, water spray head; 23, guide plate; 24, tangential hole.

DETAILED DESCRIPTION OF THE INVENTION

The invention is further described as follows with reference to accompanying drawings and specific embodiments.

Collaboration refers to the capacity to coordinate two or more individuals to perform respective functions to cooperatively fulfill a specific task. As for the complex deep-sea mining project involving various operation tasks and requiring multiple functions, it will be a very effective design method to adopt multiple pieces of equipment capable of respectively performing their own functions to work cooperatively. The invention provides a piece of submarine mining equipment which integrates intellectualization and collaboration. The whole equipment comprises an underwater detector, adaptive submarine mining collectors and a tracked mineral storage vehicle which can fulfill detection, mining, mineral storage and processing respectively. Collaborative work of all systems can remarkably improve the safety and efficiency of submarine mining operations. In addition, all the pieces of equipment are reasonably designed in terms of their operation characteristics so as to fulfill respective functions while working collaboratively, and thus, the reliability requirement is met.

Figure 10:
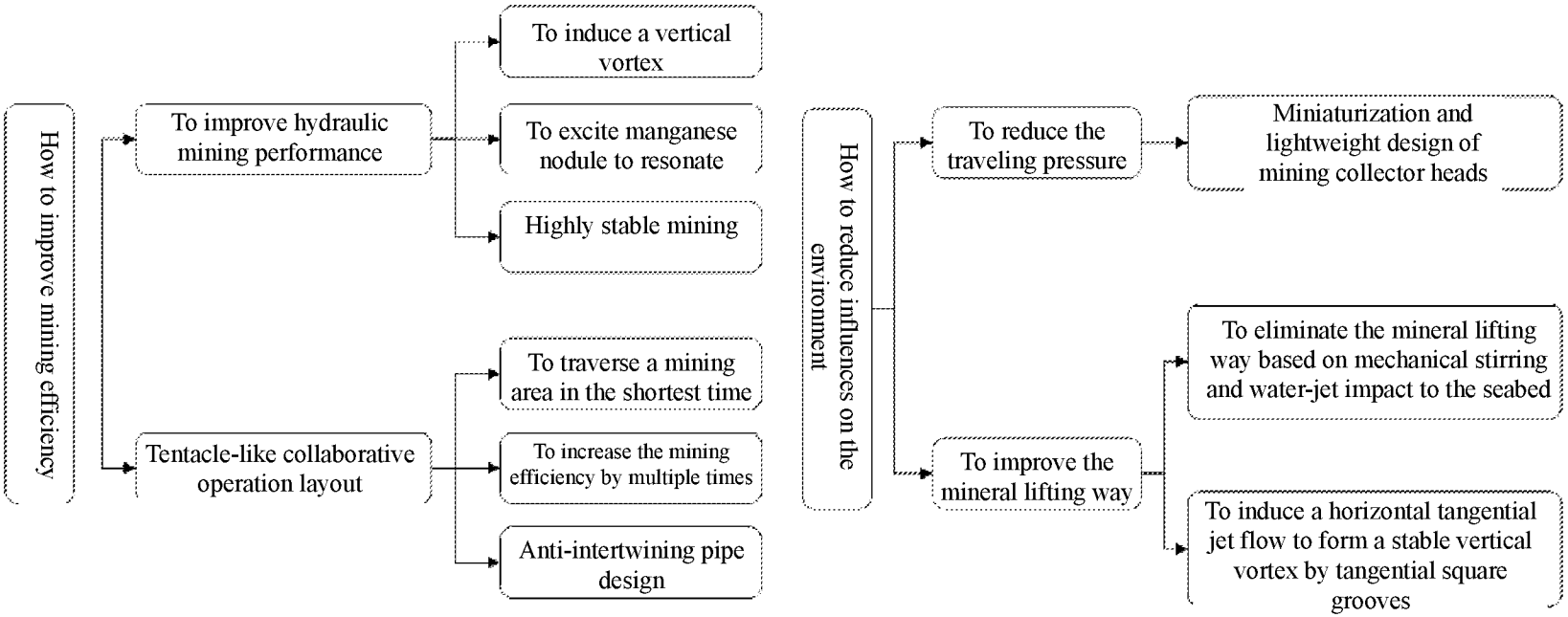
FIG. 10 is a design logic diagram of the submarine mining equipment of the invention.

Referring to FIG. 10, the general design idea of the invention is further explained as follows:

First, the mining efficiency is improved in the two aspects of enhancement of the hydraulic mining performance and tentacle-like collaborative operation layout of multiple mining collectors. A theoretical breakthrough is made by increasing the negative-pressure transmission distance based on vortex hydrodynamic characteristics, thus, effectively reducing the critical starting speed of mineral particles and enhancing the collecting power under unit energy consumption.

Second, influences on the submarine environment are weakened by reducing the traveling pressure and perfecting the mineral lifting way. The structural configuration is innovative in that a stable vertical vortex is formed by a supplementary water jet flow or a horizontal additional water jet flow by increasing the tangential angular momentum. Please refer to FIG. 10 for details.

Embodiment 1

Figure 1:
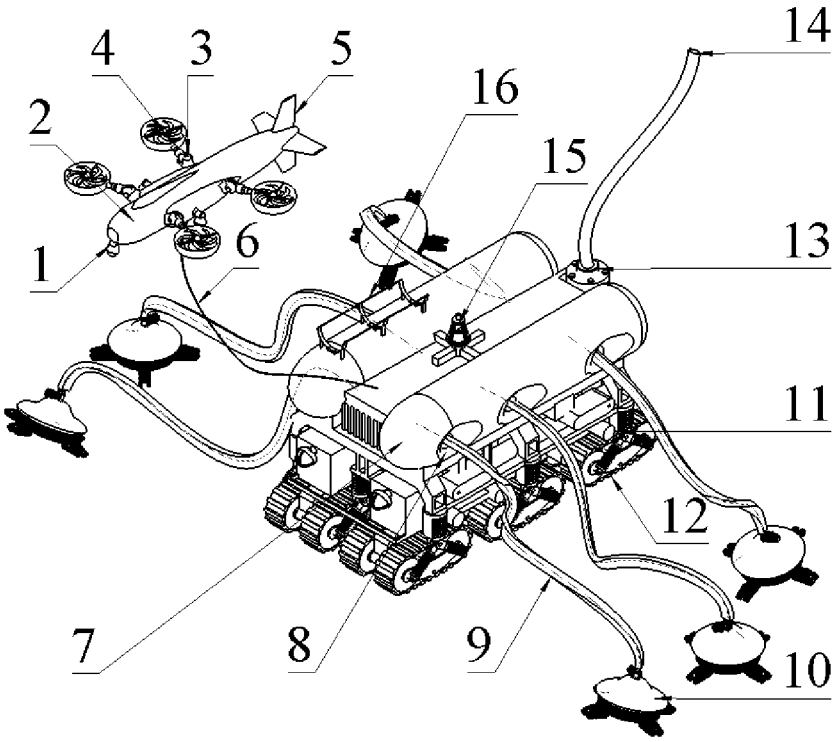
FIG. 1 is a perspective view of submarine mining equipment of the invention.
Figure 2:
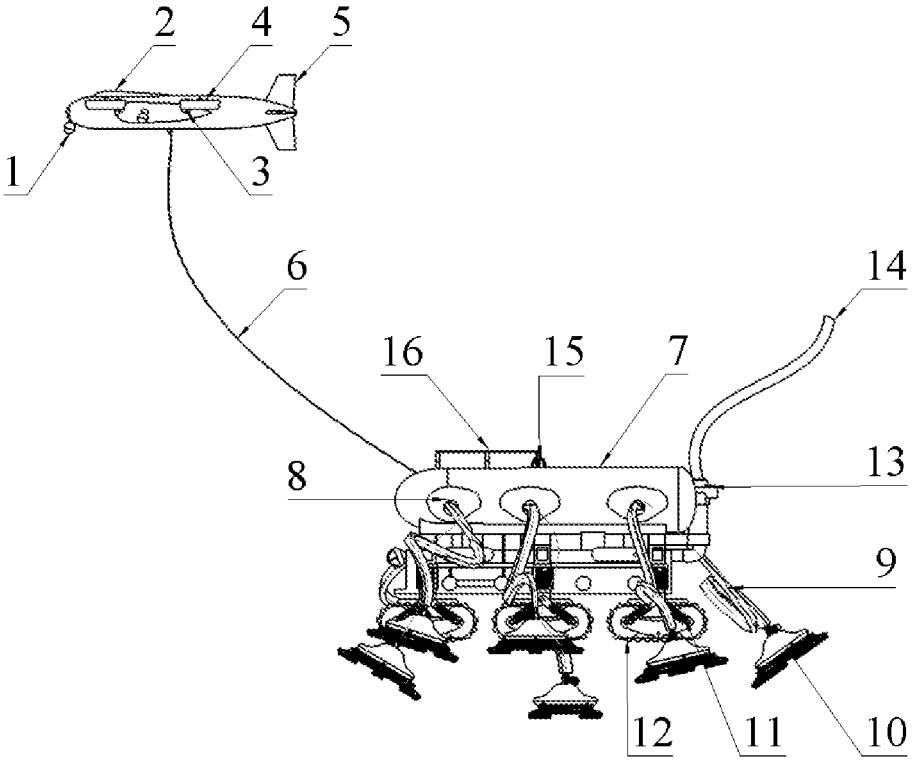
FIG. 2 is a front view of the submarine mining equipment of the invention.
Figure 3:
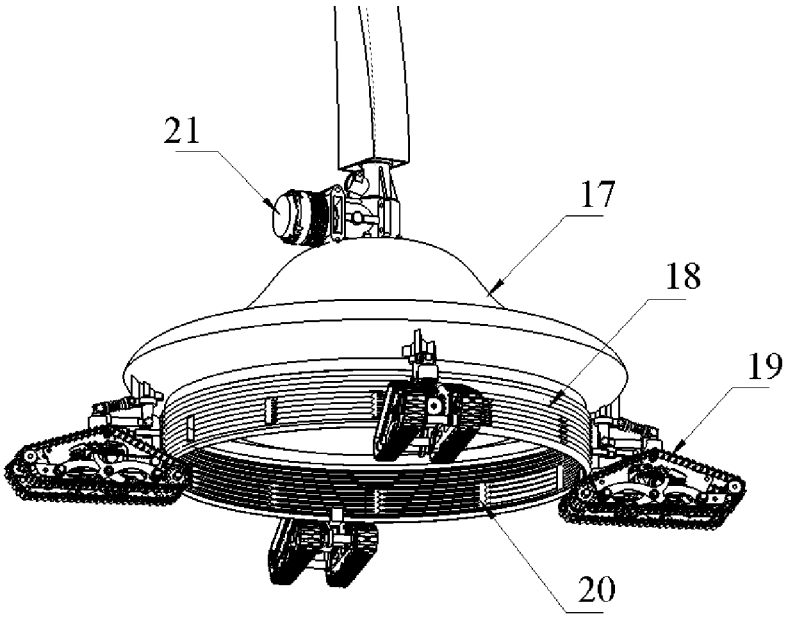
FIG. 3 is a perspective view of an adaptive submarine mining collector.
Figure 4:
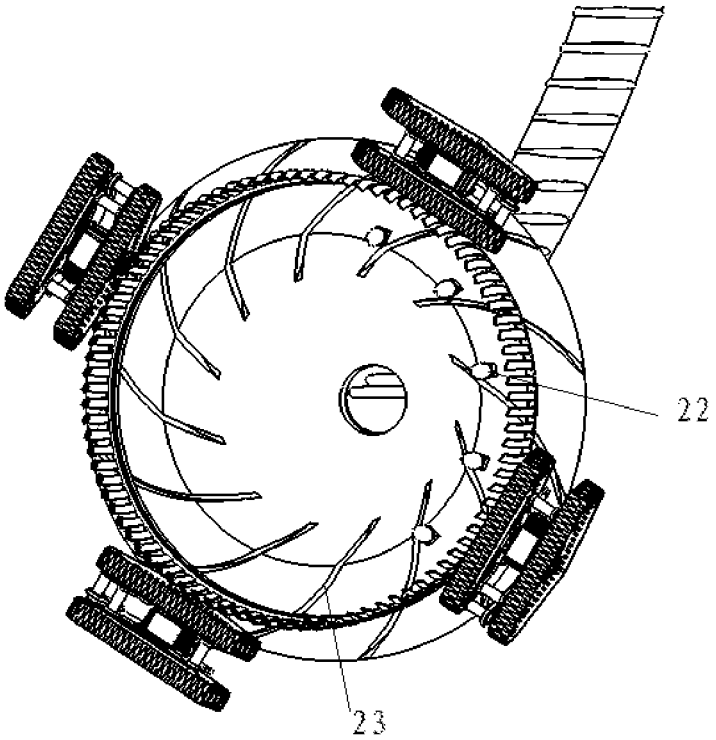
FIG. 4 is a perspective view of the bottom of the adaptive submarine mining collector.

As shown in FIGS. 1-3, a piece of submarine mining equipment comprises an underwater detector, a tracked mineral storage vehicle, adaptive submarine mining collectors and the like. The underwater detector mainly comprises a sonar detector 1, an electronic equipment compartment 2, multi-degree-of-freedom connectors 3, propellers 4, a tail wing 5 and the like. The underwater detector is connected with the tracked mineral storage vehicle through an optical cable 6. The tracked mineral storage vehicle mainly comprises a mineral storage compartment 7, mineral inlets 8, shock absorbers 11, tracked traveling devices 12, a mineral outlet 13, an external mineral delivery pipe 14, a pressure reducing valve 15, a detector berth 16 and the like. Each adaptive submarine mining collector mainly comprises a saucer-shaped cover 17, an enclosing cover 18, small tracks 19, guide grooves 20 and a water pump 21. The mining collectors are connected with the mineral inlets 8 of the mineral storage vehicle through the flat mineral delivery pipes 9.

The underwater detector is mainly used for (1) detecting the submarine topography, (2) detecting submarine mineral distribution and (3) carrying electronic equipment. The underwater detector has the self-propulsion capacity and can sail in a deep-sea environment. The sonar detector 1 is disposed on the underwater detector and is used for detecting the submarine topography and submarine mineral distribution so that a traveling path can be reasonably planned to avoid dangerous operation areas and to improve the mining efficiency. Thus, the design of the underwater detector meets the requirement for intellectualization of deep-sea mining tasks. The electronic equipment compartment 2 carries electronic equipment used for navigation control, detection, mining, mineral delivery and the like and is provided with a pressure-resistant shell capable of bearing a huge pressure from the deep sea. The underwater detector is propelled by the propellers 4 to sail, and the propellers 4 are connected with the underwater detector through the multi-degree-of-freedom connectors 3 so that the sailing posture can be adjusted by freely adjusting the direction. The tail wing 5 can keep the underwater detector stably sailing by improving the controllability of the underwater detector, and thus, the equipment in the electronic equipment compartment 2 is protected against damage. The optical cable 6 is a transmission medium integrating optical fibers and metal wires and has a power transmission function as well as an information transmission function. The underwater detector obtains power from the mineral storage vehicle via the optical cable 6 and transmits control signals to control equipment on the mineral storage vehicle to enable the mineral storage vehicle to start and carry out a mining task along a planned path. In this way, cooperative work of the underwater detector and the mineral storage vehicle is realized.

The tracked mineral storage vehicle is mainly used for (1) storing minerals from the adaptive submarine mining collectors 10, (2) processing the minerals into pulp, (3) delivering the pulp into a submarine buffer compartment, (4) providing power and a berth for the underwater detector and (5) receiving control signals from the underwater detector to control the traveling path and the mining work. Minerals from the adaptive submarine mining collectors 10 are stored in the mineral storage compartment 7. The mineral storage compartment 7 is provided with a plurality of mineral inlets 8, and each mineral inlet is connected with one adaptive submarine mining collector 10 through the corresponding flat mineral delivery pipe 9. In this way, the mineral storage compartment 7 can store minerals collected by multiple adaptive submarine mining collectors 10 within a wide scope, and thus, the total quantity of minerals collected in unit time is effectively improved, and the overall mining efficiency is improved. Mechanical devices used for adjusting the lengths of the flat mineral delivery pipes 9 are disposed in the mineral inlets 8 so that the flat mineral delivery pipes 9 can freely stretch and retreat and can be prevented from intertwining with one another. A crushing device is disposed in the mineral storage compartment 7 and can crush large mineral particles into fine particles capable of being hydraulically delivered. When the mineral storage compartment 7 is almost full of minerals, a large pulp pump delivers the minerals into the submarine buffer compartment via the mineral outlet 13 through the external mineral delivery pipe 14. Seawater can be discharged via the pressure reducing valve 15 to reduce the pressure in the mineral storage compartment when necessary. The tracked traveling devices 12 are disposed at the bottom of the mineral storage vehicle and are in surface contact with the seabed. Compared with a point contact way, the tracked traveling devices can better adapt to the soft submarine geological condition, exert a small pressure to the seabed and are small in pressure sinking, thereby being capable of continuously and stably traveling under a large load condition. The shock absorbers 11 are disposed on the tracked traveling devices 12 to reduce vibrations generated when the mineral storage vehicle travels under a complex submarine terrain, and thus, structure and equipment safety is ensured, heave compensation is conducted on mining collector chassis in time to make the mining collectors dynamically close to the seabed, and thus, stable proceeding of the mining task is ensured. The mineral storage vehicle is provided with the underwater detector berth 16 where the underwater detector can be berthed when the underwater detector completes 3D scanning of the submarine topography or is in a non-operating state or when the mining collectors are maintained.

The adaptive submarine mining collectors 10 are mainly used for (1) autonomously moving on the ocean bottom and (2) collecting submarine minerals under the pumping effect of the water pumps and induced vortexes. Each mining collector is provided with a cover body formed by one saucer-shaped cover 17 on the upper portion and one enclosing cover 18 on the lower portion. Each enclosing cover 18 has a plurality of layers of folds, thereby having high retractility and flexibility, being capable of covering the ocean bottom in a mining area, and reducing disturbance to the seabed. The guide grooves 20 are evenly formed in the surfaces of the enclosing covers 18 and are used for inducing horizontal vortexes to improve the mining effect. The bottoms of the mining collectors are provided with the small tracks 19 through which the mining collectors can autonomously travel on the seabed. The water pumps 21 are disposed on the upper portions of the mining collectors, and minerals can be pumped into the flat mineral delivery pipes 9 by the water pumps.

A plurality of guide plates 23 are disposed around the interior of each adaptive submarine mining collector 10. At least two adjacent guide plates are provided with a water spray head 22 therebetween. The water spray heads spray clear water to generate a vortex effect in the adaptive submarine mining collectors 10, and thus the collecting power is improved.

The basic idea of the invention is as follows: in terms of the characteristics of submarine mining operations, the underwater detector, the tracked mineral storage vehicle and the adaptive submarine mining collectors work collaboratively to improve the feasibility and efficiency of the submarine mining operations, and thus, intelligent, collaborative and efficient submarine mining operations are realized.

The specific working principle of the equipment is further explained as follows with reference to FIGS. 1-2:

The intelligent and collaborative submarine mining equipment is used to carry out a submarine mining task in a deep-sea area. Under the condition where the submarine topography and specific mineral distribution are unknown, the underwater detector is dispatched to perform a detection task. The underwater detector detects the submarine terrain condition and mineral distribution condition by means of the sonar detector 1, and after the acquired information is processed by a control system, the optimal traveling path is planned to improve the mining efficiency and to avoid dangerous operation areas. Multiple pieces of electronic equipment in the electronic equipment compartment 2 of the underwater detector are used to implement navigation control, detection, mining, mineral storage, processing, delivery and other tasks. The underwater detector is propelled by the multi-degree-of-freedom connectors 3 and the propellers 4. When the underwater detector needs to rise, fall or steer, the multi-degree-of-freedom connectors 3 are adjusted to change the positions and angles of the propellers 4, and thus, the sailing posture is controlled. The tail wing 5 can keep the underwater detector steady in the sailing process. Power is supplied to the underwater detector from the mineral storage vehicle via the optical cable 6, and meanwhile, control signals from the underwater detector are transmitted to the mineral storage vehicle through the optical cable 6. The mineral storage vehicle is provided with the underwater detector berth 16 where the underwater detector can be berthed when the underwater detector completes 3D scanning of the submarine topography or is in a non-operating state or the mining collectors are maintained.

The mineral storage vehicle travels along a planned path according to the control signals from the underwater detector and is provided with the tracked traveling devices 12, thereby being capable of continuously and stably traveling on the complex seabed surface. The tracked traveling devices 12 are provided with the shock absorbers 11, thereby being capable of smoothly moving on the seabed, and thus, structural safety and stable proceeding of mining operations are ensured. The mineral storage compartment 7 is provided with the multiple mineral inlets 8 and one mineral outlet 13, and each mineral inlet is connected with one adaptive submarine mining collector 10 through the corresponding flat mineral delivery pipe 9, so that the mineral storage compartment 7 can store minerals collected by the multiple adaptive submarine mining collectors 10 within a wide scope, and thus, the total quantity of minerals collected in unit time is effectively increased, and the overall mining efficiency is improved. If the mining collectors move away from the mineral storage vehicle, the lengths of the flat mineral delivery pipes 9 need to be increased; if the mining collectors move close to the mineral storage vehicle, the lengths of the flat mineral delivery pipes 9 need to be decreased; and in view of this, mechanical devices used for adjusting the lengths of the flat mineral delivery pipes 9 are disposed in the mineral inlets 8 to allow the flat mineral delivery pipes 9 to stretch and retreat freely. The mineral storage compartment 7 not only has a raw mineral material storage function, but also is provided with a processing device capable of processing raw mineral materials into pulp. With the continuous delivery of raw mineral materials by the mining collectors, the quantity of pulp stored in the mineral storage compartment is continuously increased. When the quantity of pulp in the mineral storage compartment 7 reaches a certain degree, a large pulp pump is used to deliver the pulp into the submarine buffer compartment via the mineral outlet 13 through the external mineral delivery pipe 14, and the working process can be repeated as above.

The mining collectors are connected with the mineral storage vehicle through the flat mineral delivery pipes 9 and receive power and control signals from the mineral storage vehicle via optical cables integrated in the flat mineral delivery pipes 9. The mining collectors can autonomously move within a certain submarine area by means of the small tracks so as to carry out a mining task. The enclosing covers 18 on the lower portions of the mining collectors each have a plurality of layers of folds, which can cover the ocean bottom in the mining area to reduce disturbance on other submarine areas and to make the mining collectors closer to the seabed to enhance the collecting power. After mining begins, seawater and mineral particles suffer from a large pumping force from the water pumps 21, so that a large quantity of water flows into the mining collectors via the guide grooves 20 in the surfaces of the enclosing covers 18, and then, horizontal vortexes are induced and can effectively enhance the mining effect and improve the mining efficiency. Collected mineral particles mixed with seawater and sea mud sequentially pass through the enclosing covers 19 and the saucer-shaped covers 18 and then are delivered into the mineral storage vehicle through the flat mineral delivery pipes 9 under the pumping effect of the water pumps 21.

The vertical stress distribution law of mineral particles with different granularities under different mining conditions (mining flow, mining collector watershed morphology and the like) is obtained through dimensional analysis-based numerical simulation and experimental investigation, so that the collecting power worked out through calculation and analysis in the mining process exactly meets work requirements. If the collecting power is excessive, a greater collecting flow has to be provided by the water pumps, and the traveling resistance of the tracks of the mining collectors is increased, consequentially, resulting in high energy consumption. The collecting power exactly meeting the mining requirement can minimize disturbance to the seabed, a suction force towards the seabed formed in the collection process improves the structural stability of the mining collectors, and thus, construction is safer.

This embodiment has the following innovations:

1. The underwater detector is used for detecting the submarine topography and mineral distribution in the vicinity of an operation area, and then the traveling path of the submarine mining collectors and the mineral storage vehicle is reasonably planned in terms of detected information.
2. Electronic equipment used for navigation control, detection, mining, mineral delivery and the like are disposed in the electronic equipment compartment rather than being disposed on the mineral storage vehicle.
3. The underwater detector and the mineral storage vehicle are connected through the optical cable so that both power and information can be transmitted.
4. The mineral storage vehicle is provided with the tracked traveling devices, thereby being suitable for traveling on the seabed.
5. Multiple adaptive submarine mining collectors work simultaneously and independently, so that the mining scope is widened, and total quantity of minerals collected in unit time is increased.
6. The flat mineral delivery pipes are adopted and have lengths capable of being freely adjusted by the mechanical devices.
7. The mining collectors are provided with the enclosing covers, and the enclosing covers each have a plurality of layers of folds, thereby being high retractility and flexibility.
8. A plurality of guide grooves are formed in the outer surface of the enclosing cover of each mining collector and are used for inducing horizontal vortexes.

Embodiment 2

Figure 5:
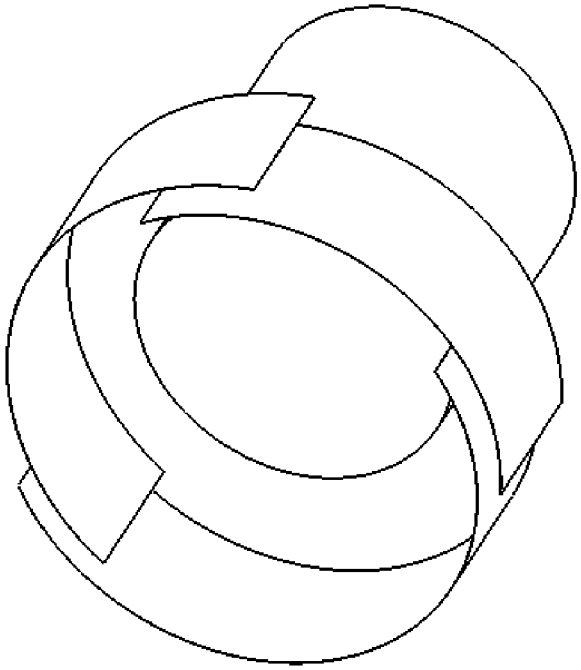
FIG. 5 is schematic view of an enclosing cover of a multi-section structure with every two adjacent sections partially overlapping with each other, so that a vortex effect is generated when outside seawater enters the adaptive submarine mining collector; water guide structures formed on the overlapped parts are matched with flow guide plates in guiding direction.

Embodiment 2 is different from embodiment 1 in the following aspects: as shown in FIG. 5, the enclosing covers are each of a multi-section structure with every two adjacent sections partially overlapping with each other, so that a vortex effect is generated when outside seawater enters the adaptive submarine mining collectors 10; and water guide structures formed on the overlapped parts are matched with the guide plates 23 in guiding direction.

Embodiment 3

Figure 6:
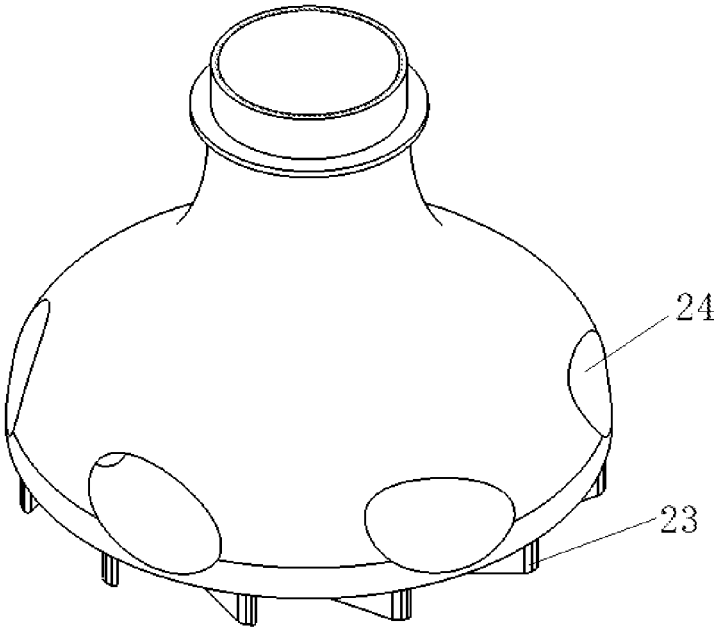
FIG. 6 is a schematic view of the external structure of the enclosing cover provided with flow guide plates and tangential holes, and in this case, two vortex inducing methods can be adopted by the mining collector according to the working condition.
Figure 7:
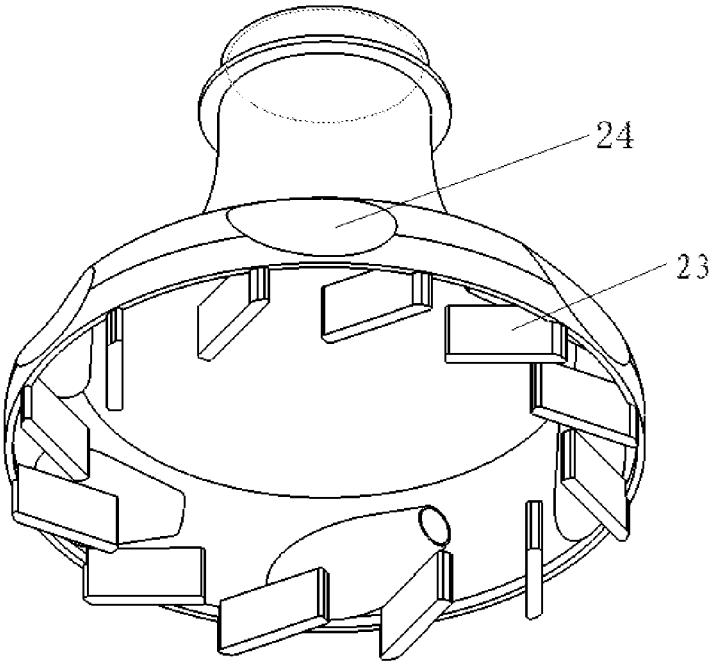
FIG. 7 is a schematic view of the internal structure of the enclosing cover provided with the flow guide plates and the tangential holes.

Embodiment 3 is different from embodiment 1 and embodiment 2 in the following aspects: as shown in FIG. 6 and FIG. 7, the guide plates 23 are disposed on the lower portions of the mining collectors, and a plurality of tangential holes 24 are formed in the surface of the lower edge of each saucer-shaped cover so that the mining collectors can adopt two vortex inducing methods according to the working condition. Particularly, when the seabed is flat and the mining collectors are close to the seabed, the vortex effect can be generated under the pumping effect of the water pumps and the guiding effect of the guide plates; and when the seabed is rough and the mining collectors fail to keep close to the seabed, horizontal water jet flows can be generated through the tangential holes to provide the angular momentum of the water flows, and thus, the vortex can still be generated.

Embodiment 4

Figure 8:
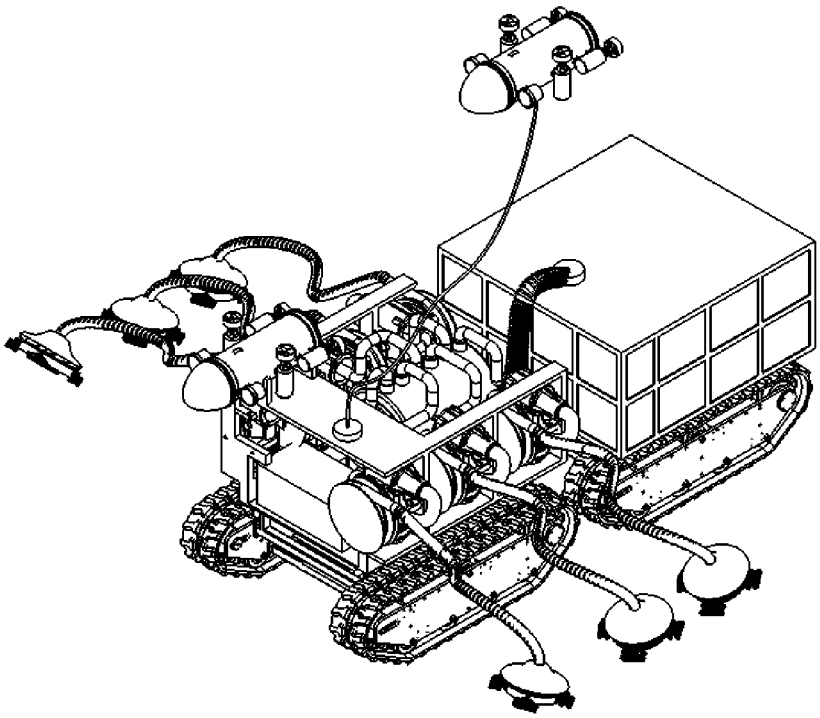
FIG. 8 is a perspective structural view of the submarine mining equipment provided with a standby underwater detector.
Figure 9:
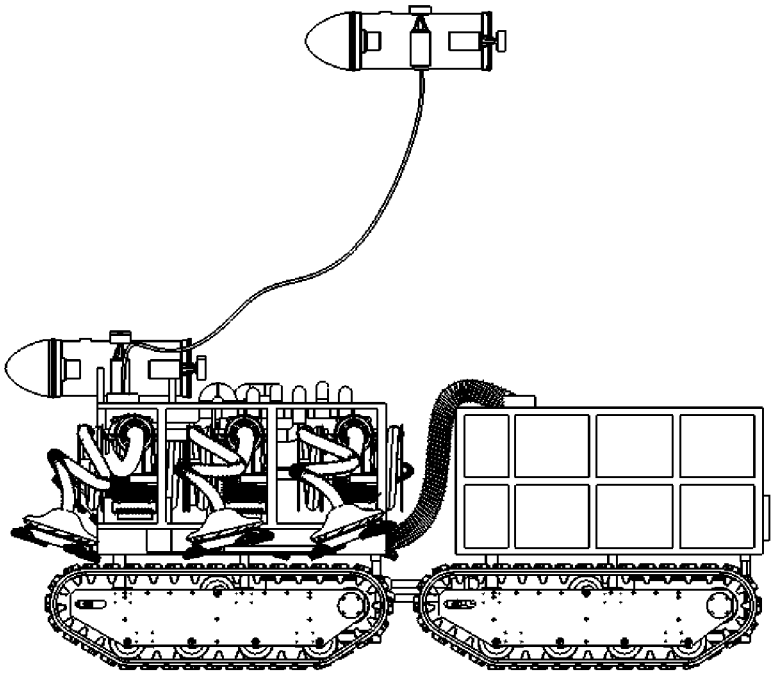
FIG. 9 is a front view of FIG. 8.

Embodiment 4 is different from embodiment 1 in the following aspects: as shown in FIG. 8 and FIG. 9, the body of the mineral storage vehicle is of a python-type all-terrain double-tracked vehicle structure. Two tracked vehicles are disposed with one in front of the other and are connected in a hinged manner. The two tracked vehicles both have the drive capacity, good over-obstacle capacity and high terrain adaptability, so that in an area with a large submarine topographical slope, the maneuverability and trafficability of the two tracked vehicles are better than those of a single tracked vehicle, and thus, the reliability in the submarine mining process is improved. In the aspect of equipment layout, the front tracked vehicle is mainly provided with water pumps, flat mineral delivery pipe adjustment devices and the like, and the rear tracked vehicle is mainly provided with a crushing device, a storage device, a delivery device and the like.

Mineral particles half buried in sea mud have a constant inherent vibration frequency range (13-17 Hz), and the collection frequency of specific vortexes, induced by the mining collectors, to the mineral particles is close to the inherent vibration frequency of the mineral particles half buried in sea mud, so that the mineral particles in sea bed are excited to resonate so as to be extracted out of sea mud more easily, and accordingly, the mining efficiency is improved.

The four embodiments mentioned above are all preferred ones of the invention. Various modifications or improvements can be made by those ordinarily skilled in the field based on the above embodiments without deviating from the conception of the invention, and all these modifications or improvements should fall within the protection scope of the invention.

What is claimed is:

1. A piece of deep-sea submarine mining equipment based on vortex hydrodynamic characteristics, comprising:

an equipment body, a plurality of adaptive submarine mining collectors and mineral delivery pipes;

wherein the equipment body and the adaptive submarine mining collectors are connected through the mineral delivery pipes, wherein each of the mineral delivery pipes has an adjustable length;

wherein the adaptive submarine mining collectors are provided with tracked traveling mechanisms and are capable of autonomously traveling under control, wherein a plurality of guide plates are disposed around an interior of each of the adaptive submarine mining collectors, at least two adjacent guide plates of each of the adaptive submarine mining collector are provided with a water spray head therebetween, wherein the water spray head sprays water to generate vortexes in the adaptive submarine mining collectors;

wherein an enclosing cover is disposed around a bottom of each of the adaptive submarine mining collectors, and wherein the enclosing cover is provided with guide grooves for guiding outside seawater into the adaptive submarine mining collectors.

2. The deep-sea submarine mining equipment according to claim 1, wherein the enclosing cover is capable of inwards retreating to rise when about to bump against obstacles and capable of automatically falling under the effect of gravity after passing over the obstacles.

3. The deep-sea submarine mining equipment according to claim 2, wherein the equipment body comprises a mineral storage compartment having a pressure reducing valve.

4. The deep-sea submarine mining equipment according to claim 2, wherein each said adaptive submarine mining collector is provided with a cover body formed by a saucer-shaped cover.

5. The deep-sea submarine mining equipment according to claim 4, wherein each said enclosing cover has a plurality of layers of folds, thereby being high in retractility and flexibility.

6. The deep-sea submarine mining equipment according to claim 1, wherein each said enclosing cover is of a multi-section structure with every two adjacent sections partially overlapping with each other, so that a vortex effect is generated when outside seawater enters the adaptive submarine mining collectors; and water guide structures formed on overlapped parts are matched with the guide plates in guiding direction.

7. The deep-sea submarine mining equipment according to claim 1, further comprising an underwater detector, and the underwater detector is electrically connected with the equipment body in a wired manner, automatically travels in front and above the equipment body, and has sonar detection and visual detection functions.

8. The deep-sea submarine mining equipment according to claim 7, wherein the underwater detector comprises a sonar detector, an electronic equipment compartment, a plurality of propellers, multi-degree-of-freedom connectors corresponding to the propellers, a tail wing and an optical cable; the multi-degree-of-freedom connectors are used to adjust a rotation direction of the propellers so as to adjust traveling and steering of the underwater detector; and the optical cable is connected with the equipment body.

9. The deep-sea submarine mining equipment according to claim 1 or 7, wherein the equipment body is provided with a mineral storage compartment, mineral inlets, shock absorbers, a plurality of tracked traveling devices, a mineral outlet, an external mineral delivery pipe and an underwater detector berth.

10. The deep-sea submarine mining equipment according to claim 9, wherein a crushing device is disposed in the mineral storage compartment and is used to crush large mineral particles into fine particles capable of being hydraulically delivered, and when the mineral storage compartment is about full of mineral particles, a large pulp pump is used to deliver the mineral particles into a submarine buffer compartment via the mineral outlet through the external mineral delivery pipe.

11. The deep-sea submarine mining equipment according to claim 9, wherein mechanical devices used for adjusting lengths of the mineral delivery pipes are disposed in the mineral inlets to allow the mineral delivery pipes to freely stretch and retreat and to prevent the mineral delivery pipes from intertwining with one another.

12. The deep-sea submarine mining equipment according to claim 1 or 7, wherein each said adaptive submarine mining collector is provided with a saucer-shaped cover, and a water pump.

13. The deep-sea submarine mining equipment according to claim 1, wherein the equipment body is of a full-terrain double-tracked vehicle form and is provided with two tracked vehicles, which are disposed with one in front of the other, are connected in a hinged manner and have a drive capacity; and the front tracked vehicle is provided with water pumps and mineral delivery pipe adjustment devices, and the rear tracked vehicle is provided with a crushing device, a storage device and a delivery device.

14. The deep-sea submarine mining equipment according to claim 1, wherein a collection frequency of specific vortexes, induced by the mining collectors, to mineral particles is close to an inherent vibration frequency of the mineral particles half buried in sea mud, so that the mineral particles in the sea mud are excited to resonate so as to be extracted from the sea mud more easily.

* * * * *